United States Patent [19]

Wightman et al.

[11] 3,930,324

[45] Jan. 6, 1976

[54] MECHANICAL EXCAVATING MACHINES INCLUDING ROTARY CUTTER AND SUCTION TUBE

[75] Inventors: David Douglas Wightman, Whitley Bay; Edward Anthony Ward, Leighton Buzzard; Timothy John Eastham Miller, Shipley, all of England

[73] Assignee: British Gas Corporation, London, England

[22] Filed: May 6, 1974

[21] Appl. No.: 467,481

[52] U.S. Cl. ..... 37/189; 37/65; 37/DIG. 1; 37/DIG. 19; 324/3; 324/41; 340/258 C; 340/421

[51] Int. Cl.[2] ..... E02F 3/88

[58] Field of Search ..... 37/58, 64, 65, 67, 189, 37/DIG. 1, DIG. 19; 324/3, 41; 340/421, 258 C

[56] References Cited

UNITED STATES PATENTS

| | | | |
|---|---|---|---|
| 1,388,650 | 8/1921 | Josephs, Jr. | 37/189 X |
| 1,762,441 | 6/1930 | Johnson | 37/189 X |
| 2,131,291 | 9/1938 | Maust | 37/DIG. 19 |
| 2,308,437 | 1/1943 | Becker | 37/65 |
| 2,561,152 | 7/1951 | Stryker | 37/DIG. 19 |
| 2,801,479 | 8/1957 | Braver | 37/189 |
| 2,807,777 | 9/1957 | Doll | 324/3 |
| 3,253,357 | 5/1966 | Allard | 37/65 |
| 3,474,549 | 10/1969 | Schnell | 37/64 X |
| 3,706,142 | 12/1972 | Brunner | 37/67 X |
| 3,763,424 | 10/1973 | Bennett, Jr. et al. | 324/41 |

FOREIGN PATENTS OR APPLICATIONS

| | | | |
|---|---|---|---|
| 65,808 | 6/1950 | Netherlands | 37/58 |

*Primary Examiner*—Clifford D. Crowder
*Attorney, Agent, or Firm*—Larson, Taylor and Hinds

[57] ABSTRACT

A mechanical hole digging machine comprising a rotary cutting tool and a suction tube having an inlet opening adjacent to the cutting tool, a suction device for applying suction to the tube remote from the inlet opening to cause material cut away by the cutting tool to be sucked inwards through the inlet opening, the cutting tool and part at least of the suction tube being carried on a mounting by which they are movable upwards and downwards. An electromagnetic metal detector comprising three coils is mounted near the cutter head and adapted in use to give an indication of the presence of buried metal service pipe during a hole digging operation.

10 Claims, 11 Drawing Figures

Figure 1:
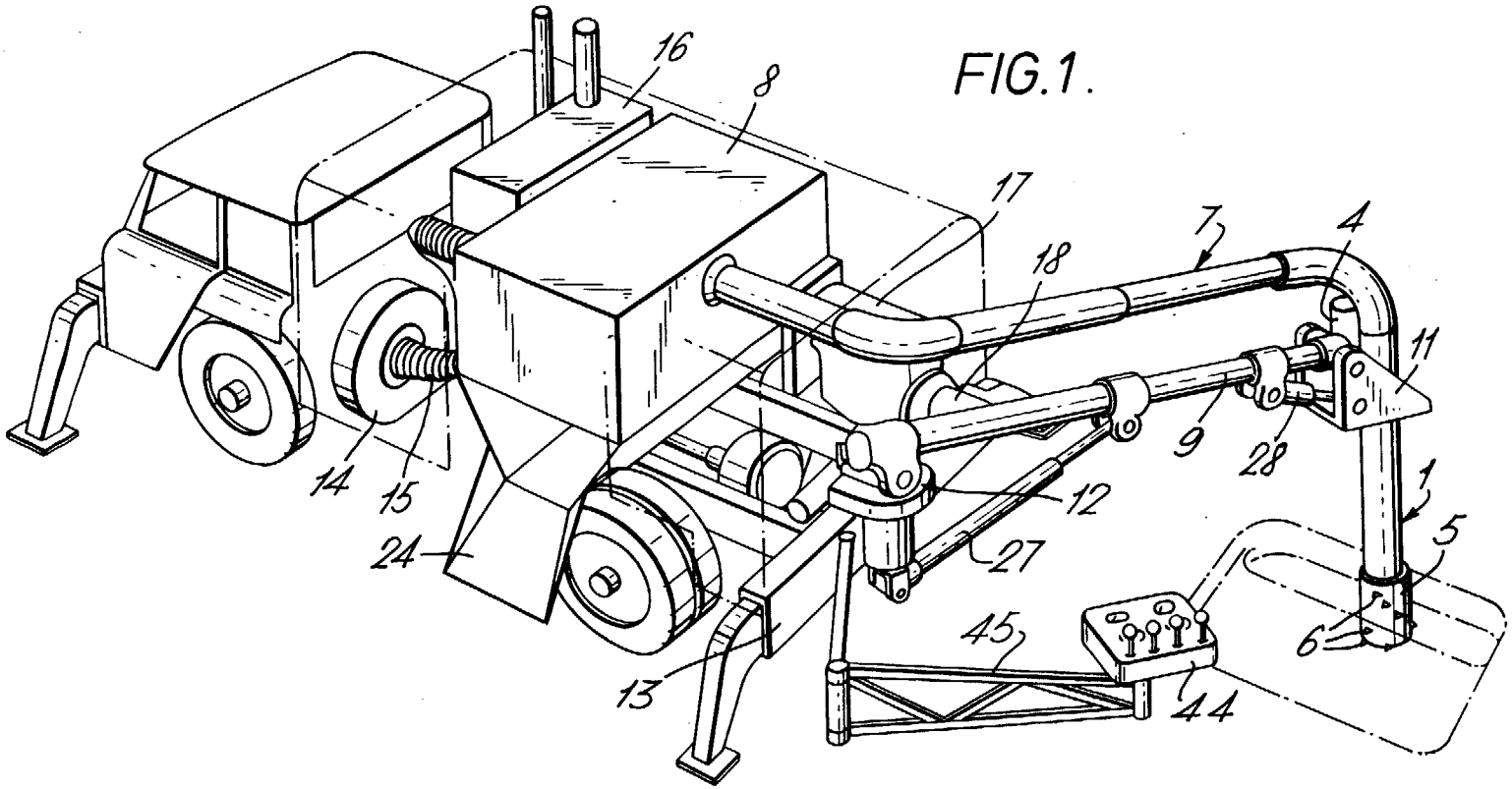

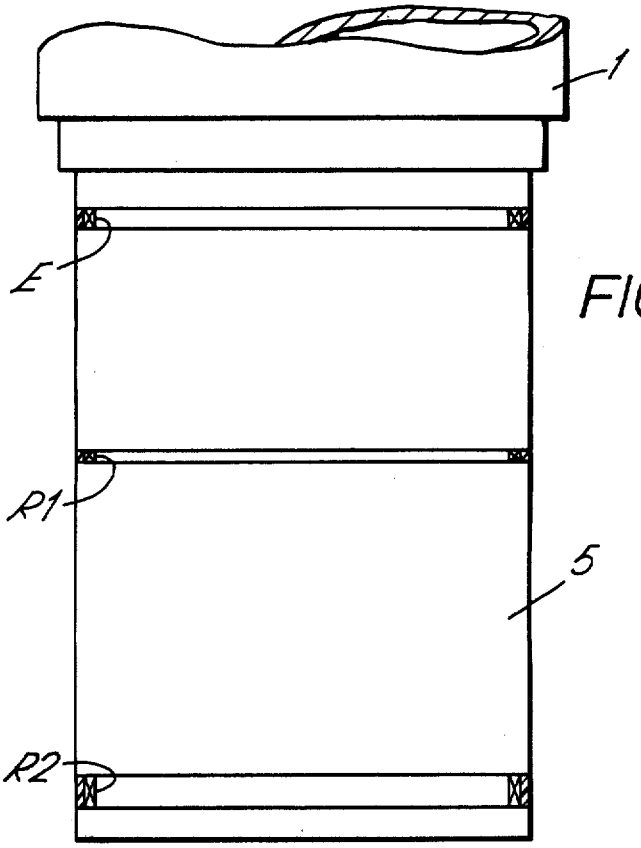
FIG. 10.
FIG. 11.
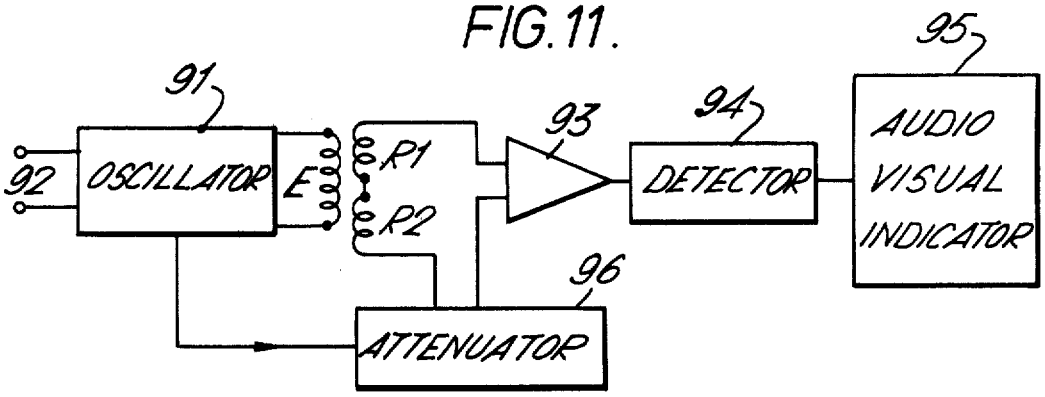

MECHANICAL EXCAVATING MACHINES INCLUDING ROTARY CUTTER AND SUCTION TUBE

This invention relates to mechanical excavating machines.

Access to gas, electricity, water and other buried services for maintenance purposes is generally achieved by local excavation of soil or other materials above and around the service. Such services are commonly laid beneath thoroughfares surfaced with tar, macadam, asphalt or other bituminous materials overlying a layer of hard core with soil below and the excavations are generally carried out manually with picks and shovels and sometimes with hand-held percussive breakers especially if there is a surface layer of concrete.

With these tools the excavation is often time consuming and is physically arduous and since the number of such excavations performed by some public utility organisations is very large indeed, it is very desirable to provide some form of excavating machine which can be used for this purpose as this can result in very substantial economies.

According to the invention, a mechanical excavating machine comprises a rotary cutting tool which is capable of cutting through compacted soil, hard core and like materials, a suction tube having an inlet opening adjacent to the cutting tool, a suction device for applying suction to the tube remote from the inlet opening to cause material cut away by the cutting tool to be sucked inwards through the inlet opening, and a driving mechanism for rotating the tool, the cutting tool and part at least of the suction tube being carried on a mounting which is adapted for movement in horizontal and vertical directions.

With this machine, small excavations previously carried out manually can be carried out very much more rapidly and the spoil from the excavation is automatically removed through the suction tube as excavation proceeds.

Preferably, the rotary cutter is mounted for rotation about the inlet opening of the suction tube which is non-rotatable, the axes of the cutter and suction tube being coincident and vertical.

The cutter may comprise of a circular hub with picks or blades which may project radially or axially downwards, or both radially and axially downwards from its periphery. The spoil cut away is entrained by air flowing into the inlet at the bottom end of the suction tube and is then conducted upwards through the suction tube away from the excavation.

The upper part of the suction tube remote from that part about which the cutter is mounted for rotation may be rigid, articulated or flexible in order to convey the cut-away spoil most easily to the required location.

The suction device may consist of a power driven pump or fan and to avoid having to pass the spoil through the pump or fan, the suction device is preferably connected to the suction tube through an enlarged settling chamber. The chamber is partially evacuated by the suction device in use and the spoil drawn into the chamber through the tube precipitates to the bottom of the chamber as it enters.

The mounting on which the cutting tool and the suction tube are carried is preferably supported by transporter means, for example, a tractor or other mobile vehicle so as to enable the machine to be transported readily from one site to another. Further, to enable the cutting tool and the suction tube to be moved upwards and downwards relative to the transporter means, the mounting may be supported by the transporter means either through mutually connected slide means or linkage means both operatively controlled by mechanisms for moving the mounting, for example, by one or more fluid pressure operated rams.

The mounting is also preferably supported by the transporter means for lateral movements relative to the transporter means through similar mutually connected slide or linkage means to enable a hole cut by the cutter to be extended sideways to increase its plan area. The control of the position of the cutter relative to the vehicle is preferably able to be effected remotely from a consol or control panel which is preferably arranged to be moveable from the transporter means to a position overlooking the excavation. In this way the excavation can proceed avoiding any other surfaces or obstructions which there may be in the vicinity of the service on which some maintenance operation is to be performed.

The cutter may be provided with a sensor means adapted in use to provide a signal for signifying the approach of the cutter to a buried metallic object such as a gas or water pipe or an electric cable.

Preferably, the sensor means comprises an electromagnetic metal detector which includes at least three coils, at least one of which is an exciter coil and at least one of which is a receiver coil, means for supplying alternating current to the exciter coil or coils and a detector for detecting any change in the nett signal induced in the receiver coil or coils, the coils being arranged so that either the signals directly induced in different receiver coils by an exciter coil are of opposite phase, or signals directly induced in a receiver coil by different exciter coils are of opposite phase.

With a metal detector of this type preferably the coils are arranged so that normally the direct signal induced in the receiver coils or coil by the exciter coil or coils is substantially zero, and therefore normally there is a null output from the receiver coils. However when an extraneous conductor is present a non-zero signal is induced which is easily detected by an element in the detector. When a non-zero signal is directly induced in the receiver coils the detector may include a phase shifting attenuator to produce a zero resultant. Again in this case when an extraneous conductor is present a non-zero signal will result and be detected by the element.

Figure 2:
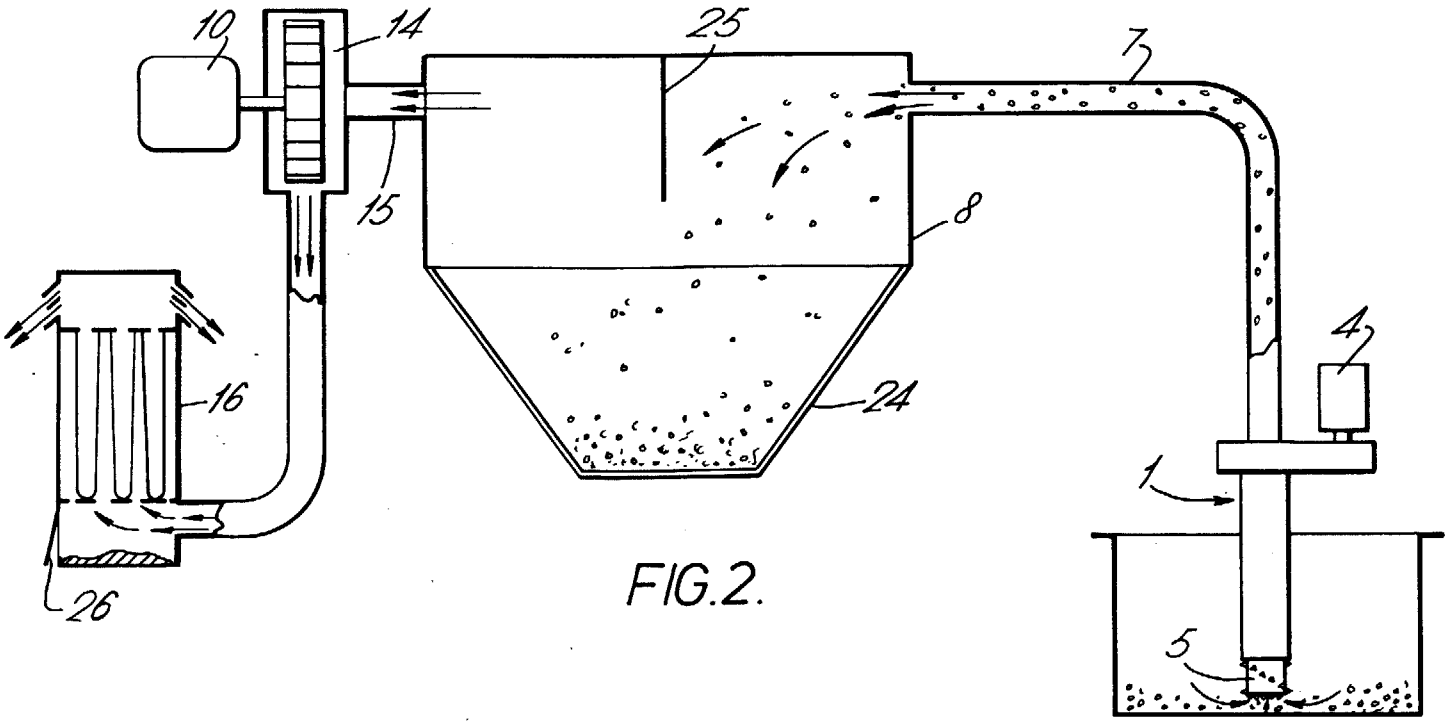
Figure 3:
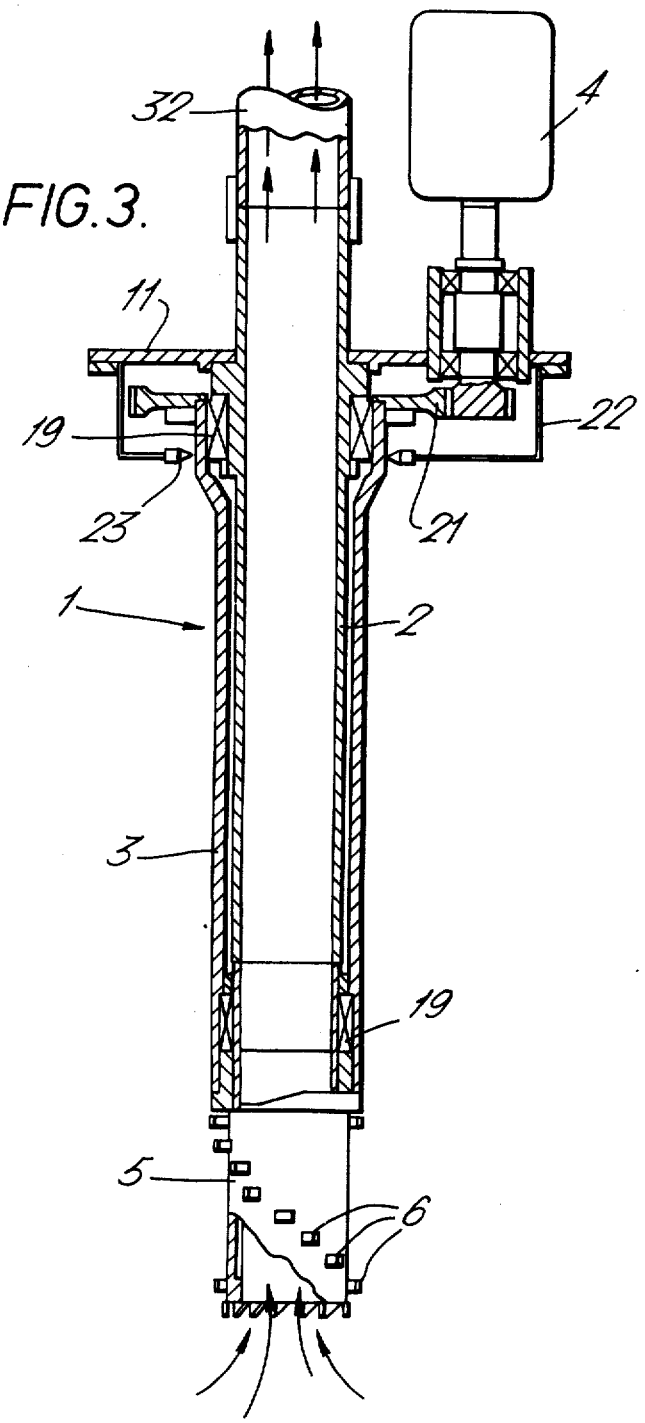
Figure 4:
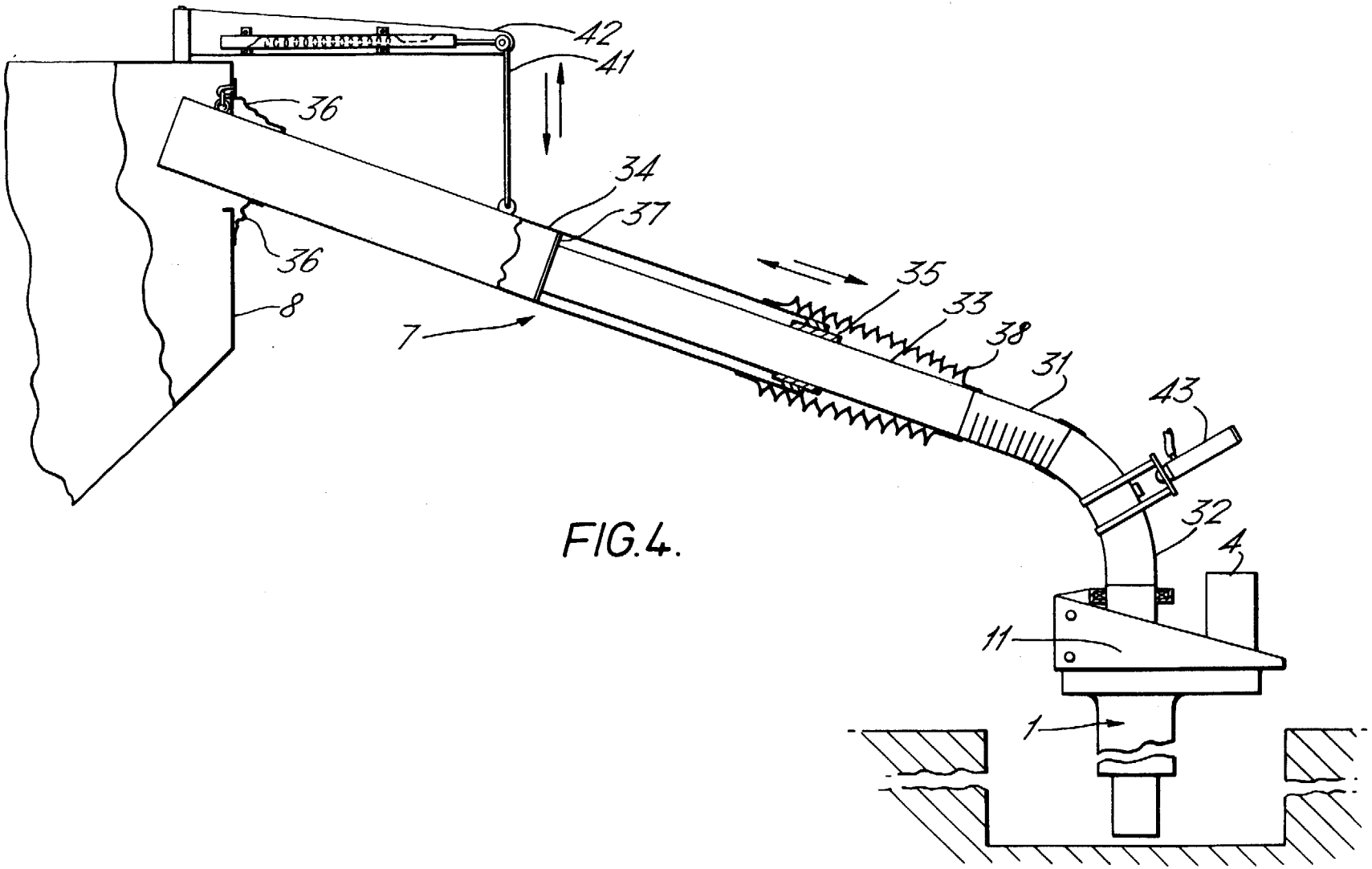
Figure 5:
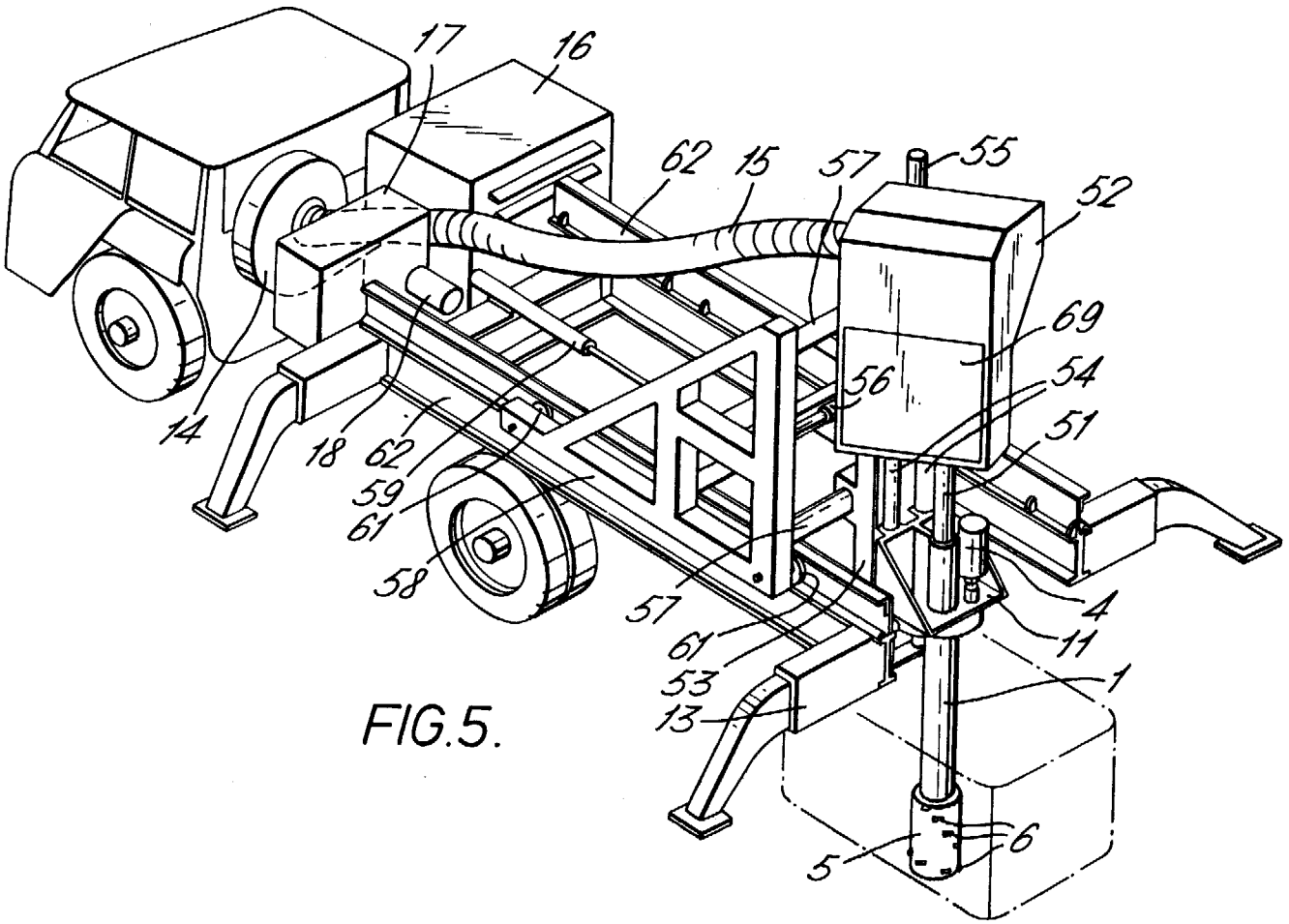
Figure 6:
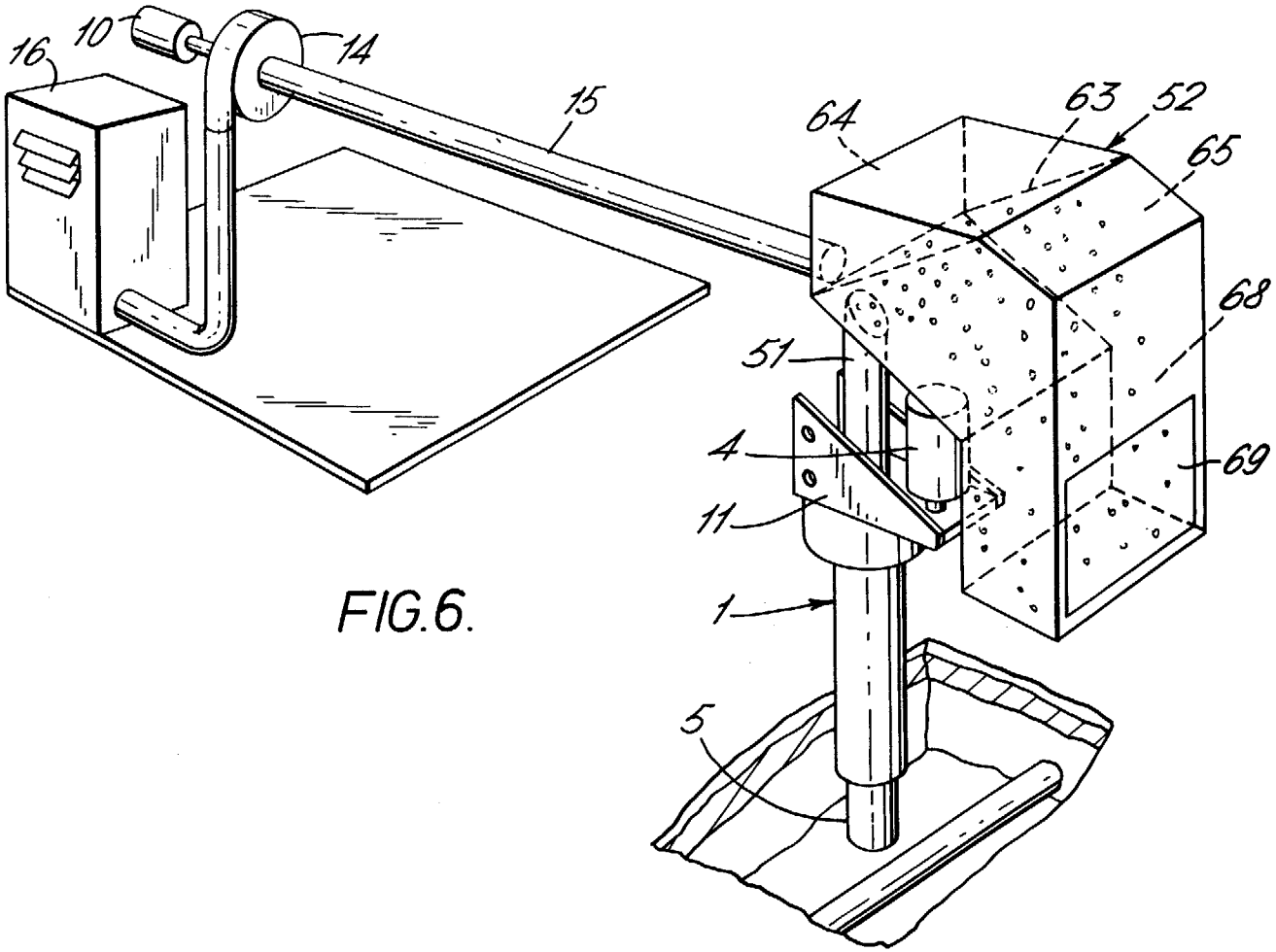
Figure 7:
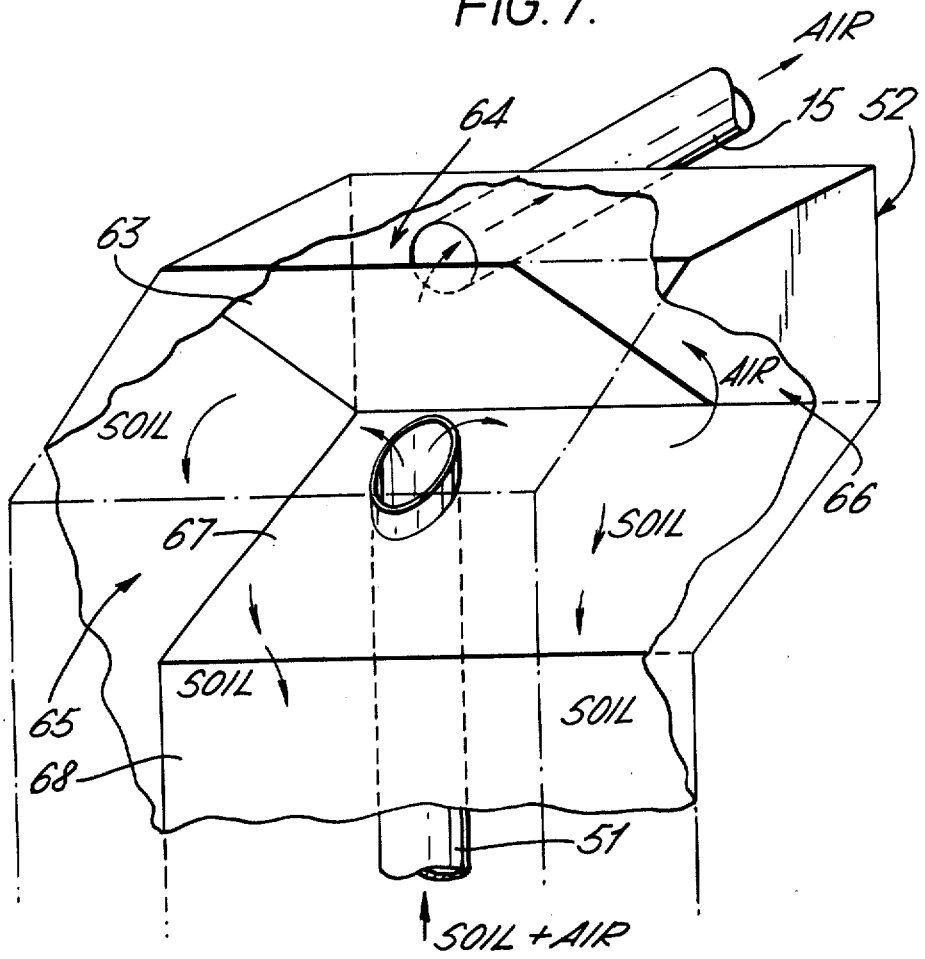
Figure 8:
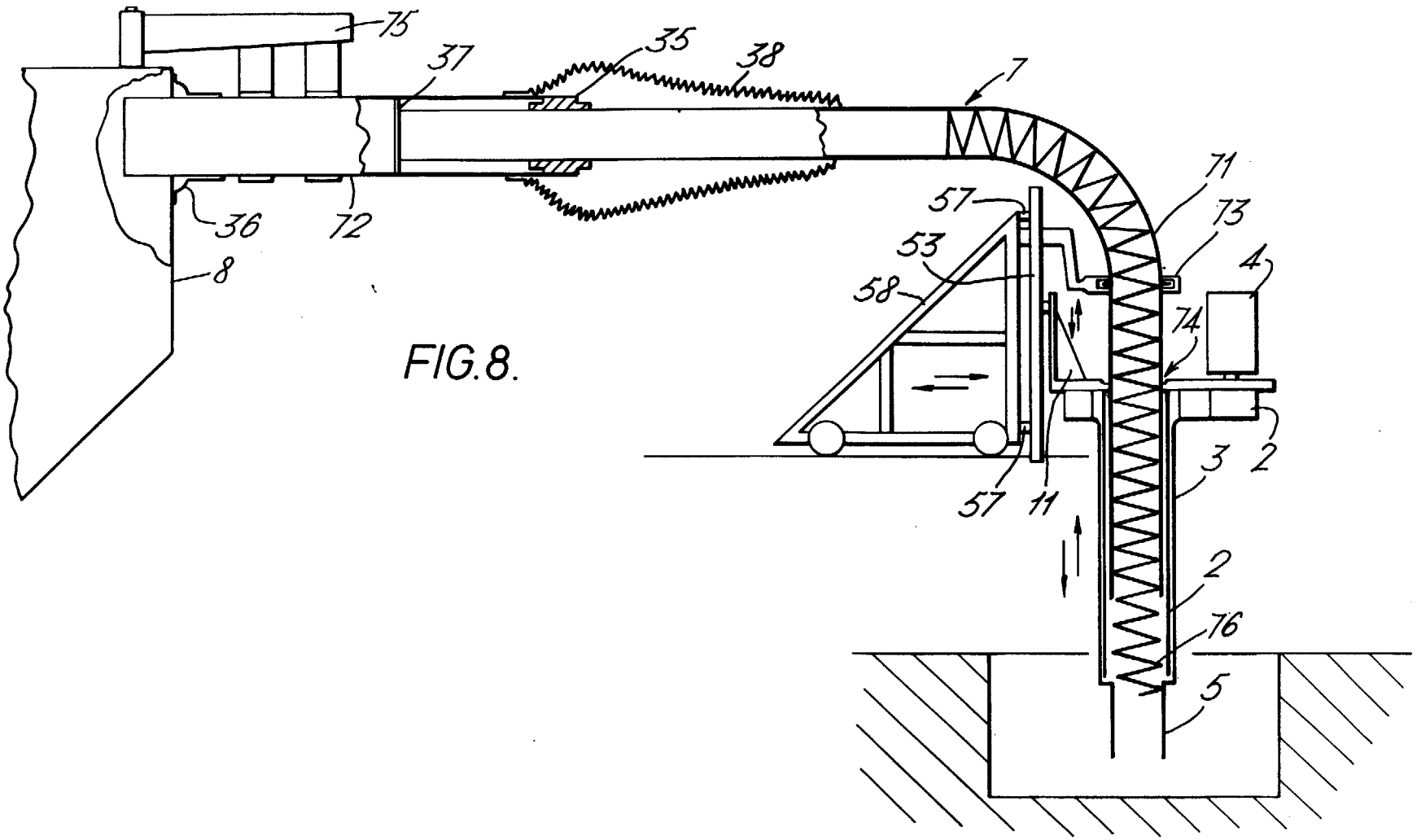
Figure 9:
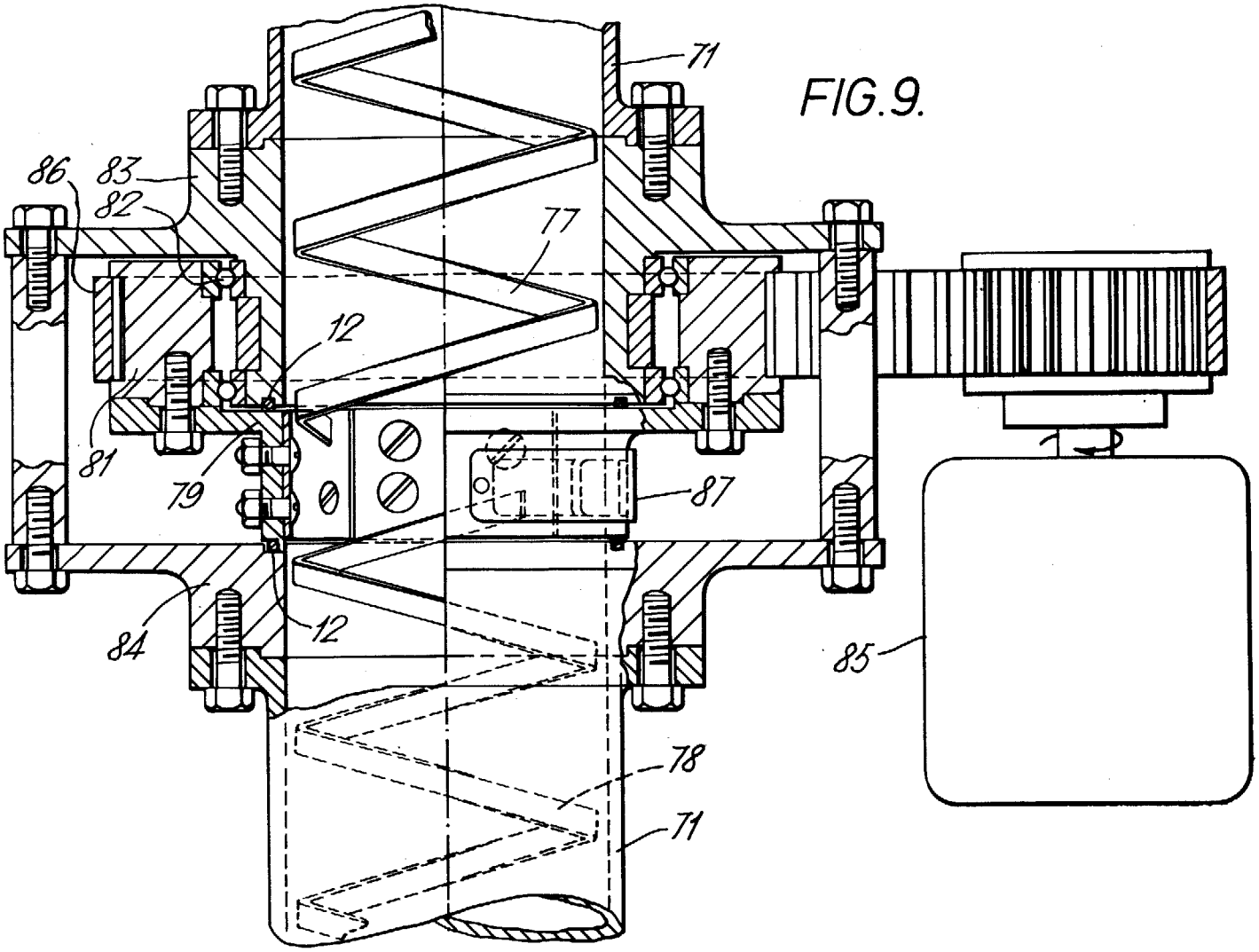

Two embodiments of the present invention will now be described by way of example with reference to the accompanying drawings in which:

FIG. 1 is a schematic perspective view showing the general arrangement of an excavating machine of the first embodiment, FIG. 2 is a schematic sectional side elevation of the suction system shown in FIG. 1, FIG. 3 is a diagrammatic central vertical sectional elevation of the cutter head shown in FIGS. 1 and 2, FIG. 4 is a diagrammatic part sectional side view of the telescopic suction tube arrangement shown in FIG. 1, FIG. 5 is a schematic perspective view showing the general arrangement of an excavating machine of the second embodiment, FIG. 6 is a schematic perspective view of the suction system shown in FIG. 5, FIG. 7 is an enlarged schematic fragmentary perspective view of the settling tank shown in FIG. 6, FIG. 8 is a diagrammatic sectional side view of an alternative form of telescopic suction tube arrangement for use in the second embodiment, FIG. 9 is an enlarged diagrammatic fragmentary sectional side elevation of a modified drive mechanism for the suction tube scraper shown in FIG. 8, FIG. 10 is a diagrammatic fragmentary elevation of the cutter incorporating the coil arrangement of a detector device, and FIG. 11 is a block schematic diagram of the detector circuit arrangement.

Referring first to the first embodiment shown in FIGS. 1 to 4, this excavating machine comprises a cutter head 1, consisting of two concentric metal tubes, that is to say a fixed inner tube 2 and a rotatable outer tube 3 driven by a hydraulic motor 4. A drum cutter 5 having a plurality of cutting picks 6 is fixed to the outer tube 3 so as to rotate with it. A suction tube 7 which will be a combination of flexible, telescopic and articulate sections is connected at one end to the top end of the cutter head 1 and at its other end to a spoil settling chamber 8. The cutter head 1 and suction tubes 7 are supported and manoeuvred by a hydraulically operated boom arm 9 connected between a cutter head support 11 and a pivotal support member 12 carried by the rear part of the transporter vehicle 13. A centrifugal fan 14 is driven by a power take off unit 10 from the vehicles engine, and its inlet communicates with the exhaust outlet 15 from the settling chamber 8. The fan 14, in turn, exhausts to a filter unit 16 which exhausts to atmosphere. An auxiliary diesel engine, 17 mounted near the rear end of the vehicle, drives an hydraulic pump 18 which supplies all the hydraulic requirements for the machine.

The fixed inner tube 2 of the cutter head 3 is carried by the bracket 11, and the outer tube 3 is mounted for rotation about the inner tube 2 by means of bearings 19. The cutting picks 6 are so arranged on the outer and the end surfaces of the drum 5 to give an augering effect thus assisting in the movement of spoil from the picks to the inner tube entrance which extends freely through the drum cutter 5 so as to reduce centrifuging effects inside the cutter in use. The outer tube 3 is driven by the motor 4 through reduction gears 21 enclosed within an oil filled sump 22 sealed by friction seals 23 to the tube 3.

The boom arm 9 is formed as two telescopically connected parts and is raised and lowered by an hydraulically operated ram 27, the bracket 11 (and hence the cutter head) being angularly adjustable in a vertical plane by an hydraulically operated ram 28. Also, movement of the boom about the pivotal support member 12 means that the cutter can be moved in three orthogonal directions.

The suction tube 7 (see FIG. 4) consists of a flexible tubular section 31 connecting at one end thereof a curved tubular section 32 to the fixed inner tube 2 of the cutter head, and at its other end to a tube 33 arranged to slide telescopically within a further tube 34 by means of a bearing 35, which tube 34 pivotally communicates with the settling chamber 8 by means of a flexible coupling 36. The enclosed end of the tube 33 is provided with a scraper ring 37 which also acts as a seal for preventing spoil particles from entering the annular space between the tubes, the space also being enclosed by a concertina like garter 38. The tube 34 is supported by a spring loaded cable 41 carried by a cantilever arm 42, pivotally mounted on the chamber 8, whereby to compensate for changing angular movements of the suction tube and to reduce the transmission of bending momments to a minimum. A pneumatically operated impact hammer 43 mounted on the suction tube section 32 may be used to dislodge any built up spoil passing through its bend. Alternatively, for this purpose, a rotatably driven internally disposed helical spring (such as will be described later with reference to FIGS. 8 and 9 of the second embodiment) may be used. A control panel 44 pivotally supported on a folding arm 45 may be selectively positioned near the hole being excavated for enabling an operator to control the excavating operation more easily, which, in this case can be to the rear or sides of the vehicle.

In operation of this first embodiment (see FIG. 2), the cutter head is lowered by the boom until it is in contact with the ground surface and the cutter rotated to start the excavation. The fan 14 creates a partial vacuum in the settling chamber 8 and excavated spoil fragmented by the cutter 5 is entrained by the suction air steam and drawn into the chamber 8 through the suction tube 7. The air spoil mixture enters the chamber where the air expands causing its velocity to decrease which in turn causes precipitation of the spoil to settle at the bottom of the chamber where it can subsequently be removed through an access door 24. A baffle plate 25 is suspended from the roof of the chamber 8 whereby to divert the air spoil stream entering the chamber so as to assist in the separation. The settling process removes all but the finest particles of spoil which are then absorbed by the filter 16 which also serves as a silencer for the system. Filtered spoil particles can be removed through an access door 26.

Referring now to the second embodiment shown in FIGS. 5 to 9 this excavating machine primarily differs from the machine already described in that the mode of manouvering the cutter head is by a sliding frame arrangement necessitating different suction tube and settling chamber arrangements, and therefore similar components to those already described bear the same reference numerals and will not be described again.

The cutter head 1 is the same as before, but in this case a suction tube 51 is rigidly attached to a settling chamber 52 which is mounted on a frame member 53, the tube 51 being arranged to slide telescopically within the fixed inner tube 2 of the cutter head (see FIG. 6) when the bracket 11 (and hence the cutter head 1) is caused to be moved in vertical directions on guides 54 fixed to the frame 53 by an hydraulically operated ram 55. The frame 53 is slideably mounted for lateral movement by an hydraulically operated ram 56 on horizontal guides 57 which are carried by a carriage 58. This carriage 58 is supported for longitudinal sliding movement on the vehicle 13 by means of rollers 61 which run in rails 62 fixed to the vehicle. Movement of the carriage 58 is achieved by the operation of an hydraulic ram 59. Thus it will be seen that with this arrangement, the cutter head can again be manouvred into three orthogonal directions and that the settling chamber 52 moves with the cutter head 1 in the two horizontal directions thereof.

The settling chamber 52 (see FIGS. 6 and 7) is provided with a baffle plate 63 extending angularly part way across the top of the chamber whereby to divide it into two compartments 64, 65 except for an air passageway 66. The suction tube 51 projects slightly into the compartment 65 and the exhaust tube 15 communicates with the compartment 64. The bottom part 67 of the chamber slopes downwardly from the baffle 63 so that the precipitate spoil will tend to roll or slide downwardly into the deeper front compartment 68 which is provided with an access door 69 for the removal of spoil. An alternative settling chamber arrangement similar to that previously described with reference to the first embodiment may be employed in this embodiment provided the necessary space can be made available on the vehicle for mounting it, in which case the modified suction tube arrangements shown in FIG. 8 will be used. In this modified arrangement the raising and lowering of the suction tube 7 in the manner previously described is prevented by the vertical sliding frame arrangement.

This is overcome by forming the suction tube in two rigid sections 71, 72 similarly telescopically connected together as before with a sliding bearing 35, scraper seal 37 and concertina type garter 38. The tubular section 71 is supported by the carriage 58 by means of a thrust bearing 73 fixed to it. The bearing 73 maintains vertical positioning of the tube section 71 whilst allowing it to rotate when the cutter head is moved in lateral directions. The tube section 71 extends telescopically within the fixed inner tube 2 of the cutter head and an air-tight friction seal 74 is provided there-between. The tube section 72 is firmly supported in vertical and horizontal planes by a pivoted arm 75 which allows the suction tube to pivot when the cutter head is moved laterally.

A helically wound scraper spring 76 is disposed within the vertical and curved portions of the tube section 71 and is caused to rotate relative to the tube by being attached at its lower end to the rotatable cutter drum 5, whereby in use to scrape and dislodge spoil particles that may have become deposited in the tube.

In an alternative arrangement (see FIG. 9) designed to avoid excessive loads which may be incurred on a spring driven from one end only, the spring 76 is driven from a point approximately mid-way along its length. With this arrangement, adjacent ends of two spring sections 77, 78 are fixed to a flange 79 which is bolted to a pulley 81 journalled on bearings 82 carried by fixed support members 83, 84 connecting the split portions of the suction tube section 71. The pulley 81 is driven by a motor 85 through a toothed belt 86. An access hole 87 is provided in flange 79 for enabling the spring fixings to be released and the springs removed for maintenance purposes.

The mode of operation of this second embodiment is similar to that already described with reference to the first embodiment with the exception that the particular construction for maneuvering the cutter head permits excavation at the rear of the vehicle only since lateral movement of the cutter head is constrained within the traversing limits of the frame 53.

Referring now to FIGS. 10 and 11, in an example of an electromagnetic detector for sensing the approach in use of the cutter drum 5 to a buried metallic gas or water pipe or an electric cable, the detector includes three coils namely an exciter coil E and two receiver coils R1 and R2. The three coils are wound circumferentially with the exciter coil uppermost in respective shallow grooves formed in the outer surface of the cutter drum 5 so that the coils rotate with the cutter, the grooves preferably being sealed after winding the coils with a suitable material, for example an epoxy resin material.

The electric circuit arrangement for operating the detector includes an oscillator 91 energised from an electric current supply 92, the alternating current output from the oscillator being fed to the primary exciter coil E. The induced output signal from the series connected receiver coils R1, R2 is preferably fed into a high-gain amplifier 93 before a detector stage 94, the direct current output therefrom being used either to give an audio or visual warning by an indicator 95 and/or to stop automatically the advance of the cutting tool. Furthermore, such an arrangement gives a greater and variable range of detection possibly enabling it to be used for the initial location of the service. Because of slight variations that may occur during manufacture in the size, concentricity or location of the receiver coils, and because of rotation of the cutter drum relative to stationary metallic components, there may be a small residual signal from the receiver coils when there is no buried conducting object in the field of the exciter coils. To compensate for this a signal derived from a variable phase attenuator 96 driven from the output of the oscillator, or from some other source, may be added to the output signal from the receiver coils to produce a desired zero resultant.

To enable current carrying power cables to be detected more easily the detector may be provided with a coil or any combination of coils connected to a circuit that detects and responds to electro-magnetic signals having a frequency of 50 Hz or any multiple thereof.

In use, the alternating current flowing through the exciter coil E produces an alternating electro-magnetic field around the exciter coil. This field induces an alternating current in any extraneous conductor present within the field, but in the absence of any such conductor the currents induced in the two receiver coils R1, R2 are of opposite phase but have equal magnitudes and so usually cancel each other out. Thus, little or no net signal is induced in the receiver coils directly from the exciter coil.

If however there is an extraneous conductor present in the field of the exciter coil this will also have an alternating current induced in it. The alternating current induced in this conductor will set up a secondary alternating electro-magnetic field. This secondary field will induce an alternating current in each of the receiver coils R1, R2 and provided that the conductor is closer to one of the receiver coils than to the other, the magnitudes of the signals induced in the coils will be different and so a net signal will be induced in the receiver coils.

It will be appreciated that determination of parameters such as the number of the turns in the coil windings and their relative spacing along the cutter drum, and the design of the operating circuit to give a satisfactory detecting range for the detector, will depend to a great extent on the material employed in the manufacture of the cutter drum, the wall thickness of the drum (particularly where it is of ferro-magnetic material), the rotational concentricity of the drums (and hence the coils), and the proximity of the coils to the outer peripheral surface. These and other design considerations will, of course, be apparent to those skilled in the art.

We claim:

1. A mechanical excavating machine comprising a rotary cutting tool which is capable of cutting through compacted soil, hard core and like materials, a suction tube having an inlet opening adjacent to the cutting tool, a suction device for applying suction to the tube remote from the inlet opening to cause material cut away by the cutting tool to be sucked inwards through the inlet opening, and a driving mechanism for rotating the tool, the cutting tool and part at least of the suction tube being carried on a mounting which is adapted for movement in horizontal and vertical directions, the inlet opening of the suction tube being nonrotatable, the rotary cutter being mounted for rotation about said inlet opening, and the axes of the cutter and suction tube being coincident and vertical, said cutter being provided with a sensor means for providing a signal for signifying the approach of the cutter to a buried metallic object, said sensor means comprising an electromagnetic metal detector which includes at least three coils mounted on said cutter, at least one of which said coils is an exciter coil and at least one of which said coils is a receiver coil, means for supplying alternating current to said exciter coil and a detector for detecting any change in the net signal induced in the receiver coil.

2. A mechanical excavating machine according to claim 1, wherein the coils are arranged so that normally a direct signal is induced in a receiver coil by an exciter coil which is substantially zero and hence normally there is a null output from a receiver coil.

3. A mechanical excavating machine according to claim 1, including a phase shifting attenuator arranged to produce a zero resultant when a non-zero signal is directly induced in a receiver coil.

4. A mechanical excavating machine according to claim 1, wherein the cutter comprises a circular hub with teeth which project radially and axially downwards, from its periphery.

5. A mechanical excavating machine according to claim 1, wherein the suction device comprises a power driven fan.

6. A mechanical excavating machine according to claim 1, wherein the suction device is connected to the suction tube through an enlarged settling chamber, and wherein the chamber is partially evacuated by the suction device in use and the spoil drawn into the chamber through the tube precipitates to the bottom of the chamber as it enters.

7. A mechanical excavating machine according to claim 1, wherein the mounting which carries the cutting tool and the suction tube is supported by transporter means.

8. A mechanical excavating machine according to claim 7, wherein the mounting is supported by the transporter means through mutually connected moveable means operatively controlled by mechanisms for moving the mounting.

9. A mechanical excavating machine according to claim 8, wherein the position of the cutter relative to the vehicle can be remotely controlled from a control panel.

10. A mechanical excavating machine according to claim 7, wherein the mounting is supported by the transporter means for lateral movement relative to the transporter means through further moveable means operatively controlled by further mechanisms for moving the mounting.

* * * * *